US009248989B2

(12) United States Patent
Kasiske, Jr. et al.

(10) Patent No.: US 9,248,989 B2
(45) Date of Patent: Feb. 2, 2016

(54) POSITIVE PRESSURE WEB WRINKLE REDUCTION SYSTEM

(71) Applicants: W. Charles Kasiske, Jr., Webster, NY (US); Kevin A. Cole, Ontario, NY (US)

(72) Inventors: W. Charles Kasiske, Jr., Webster, NY (US); Kevin A. Cole, Ontario, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 319 days.

(21) Appl. No.: 14/016,427

(22) Filed: Sep. 3, 2013

(65) Prior Publication Data

US 2015/0060511 A1 Mar. 5, 2015

(51) Int. Cl.
*B65H 20/14* (2006.01)

(52) U.S. Cl.
CPC ..... *B65H 20/14* (2013.01); *B65H 2404/1313* (2013.01); *B65H 2404/1314* (2013.01); *B65H 2404/1363* (2013.01); *B65H 2404/13161* (2013.01); *B65H 2404/13162* (2013.01); *B65H 2404/154* (2013.01); *B65H 2404/7431* (2013.01); *B65H 2406/111* (2013.01); *B65H 2801/15* (2013.01)

(58) Field of Classification Search
CPC ..... B65H 5/228; B65H 20/12; B65H 20/14; B65H 2404/113; B65H 2406/111; B65H 2406/112; B65H 2406/113; B65H 2406/1132; B65H 2406/12; B65H 2406/121; B65H 2406/1211; B65H 2406/122; B65H 2406/1363; B65H 2404/1363
See application file for complete search history.

(56) References Cited

U.S. PATENT DOCUMENTS 3,342,481 A 9/1967 Kaplan
3,405,855 A 10/1968 Daly et al.
3,567,093 A 3/1971 Johnson
4,165,132 A 8/1979 Hassan
4,231,272 A 11/1980 Crouse
4,717,938 A * 1/1988 Tanjo ..... B32B 38/1866 271/161
5,036,737 A 8/1991 Glaser
5,246,155 A 9/1993 Barrois
6,125,754 A * 10/2000 Harris ..... B41F 13/02 101/420
6,305,772 B1 10/2001 Berkoben et al.
6,427,941 B1 8/2002 Hikita
7,311,234 B2 * 12/2007 Solberg ..... B65H 23/24 226/193
8,303,106 B2 11/2012 Kasiske et al.
8,936,243 B1 1/2015 Muir et al.
2003/0049042 A1 3/2003 Bogoshian
2009/0295061 A1 * 12/2009 Honda ..... B41J 13/0036 271/3.14
2011/0135405 A1 6/2011 Miyaji et al.
2013/0341858 A1 12/2013 Herrmann

FOREIGN PATENT DOCUMENTS

JP 63277163 A * 11/1988
WO 2004-074148 A2 9/2004

* cited by examiner

*Primary Examiner* — Michael McCullough
(74) *Attorney, Agent, or Firm* — Kevin E. Spaulding

(57) ABSTRACT

A web-guiding system for guiding a web of media travelling from upstream to downstream along a transport path in an in-track direction, including a web-guiding structure and an air source. The web-guiding structure includes an exterior surface having a pattern of recesses formed into the exterior surface, wherein the web of media travels past the web-guiding structure with a first side of the web of media contacting at least some non-recessed portions of the exterior surface of the web-guiding structure. The air source provides an air flow between the first side of the web of media and the exterior surface of the web-guiding structure thereby providing a lifting force to lift portions of the web of media overlying the recesses away from the exterior surface of the web-guiding structure.

23 Claims, 21 Drawing Sheets

POSITIVE PRESSURE WEB WRINKLE REDUCTION SYSTEM

CROSS-REFERENCE TO RELATED APPLICATIONS

Reference is made to commonly assigned, U.S. patent application Ser. No. 14/016,440 (now U.S. Publication No. 2015/0060512), filed Sep. 3, 2013, entitled "Negative pressure web wrinkle reduction system" by Kasiske et al., the disclosure of which is incorporated herein by reference.

FIELD OF THE INVENTION

This invention pertains to the field of media transport and more particularly to an apparatus for reducing wrinkles while guiding a receiver media web.

BACKGROUND OF THE INVENTION

In a digitally controlled inkjet printing system, a receiver media (also referred to as a print medium) is conveyed past a series of components. The receiver media can be a cut sheet of receiver media or a continuous web of receiver media. A web or cut sheet transport system physically moves the receiver media through the printing system. As the receiver media moves through the printing system, liquid (e.g., ink), is applied to the receiver media by one or more printheads through a process commonly referred to as jetting of the liquid. The jetting of liquid onto the receiver media introduces significant moisture content to the receiver media, particularly when the system is used to print multiple colors on a receiver media. Due to the added moisture content, an absorbent receiver media expands and contracts in a non-isotropic manner, often with significant hysteresis. The continual change of dimensional characteristics of the receiver media can adversely affect image quality. Although drying is used to remove moisture from the receiver media, drying can also cause changes in the dimensional characteristics of the receiver media that can also adversely affect image quality.

FIG. 1 illustrates a type of distortion of a receiver media 3 that can occur during an inkjet printing process. As the receiver media 3 absorbs the water-based inks applied to it, the receiver media 3 tends to expand. The receiver media 3 is advanced through the system in an in-track direction 4. The perpendicular direction is commonly referred to as the cross-track direction 7. Typically, as the receiver media 3 expands in the cross-track direction 7, contact between the receiver media 3 and contact surface 8 of rollers 2 (or other web guiding components) in the inkjet printing system can produce sufficient friction such that the receiver media 3 is not free to slide in the cross-track direction 7. This can result in localized buckling of the receiver media 3 away from the rollers 2 to create lengthwise flutes 5, also called ripples or wrinkles, in the receiver media 3. Wrinkling of the receiver media 3 during the printing process can lead to permanent creases in the receiver media 3 which adversely affects image quality.

There remains a need for a means to prevent the formation of receiver media wrinkles as a receiver media contacts web-guiding structures in a digital printing system.

SUMMARY OF THE INVENTION

The present invention represents a web-guiding system for guiding a web of media travelling from upstream to downstream along a transport path in an in-track direction, the web of media having a first side and an opposing second side, comprising:

a web-guiding structure including an exterior surface having a pattern of recesses formed into the exterior surface, wherein the web of media travels past the web-guiding structure with the first side of the web of media contacting at least some non-recessed portions of the exterior surface of the web-guiding structure; and an air source for providing an air flow between the first side of the web of media and the exterior surface of the web-guiding structure thereby producing a lifting force to lift portions of the web of media overlying the recesses away from the exterior surface of the web-guiding structure.

This invention has the advantage that wrinkles are prevented from forming in the web of media as it passes around the web-guiding structure by causing portions of the web of media overlying the recesses to lift away from the web-guiding structure. This is particularly important for printing systems such as inkjet where significant levels of media expansion result from the application of liquid ink to the media.

It has the additional advantage that larger deflections in the web of media are possible relative to alternate configurations where the media sags into the recesses, and therefore wrinkles can be prevented for larger amounts of media expansion.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

Figure 1:
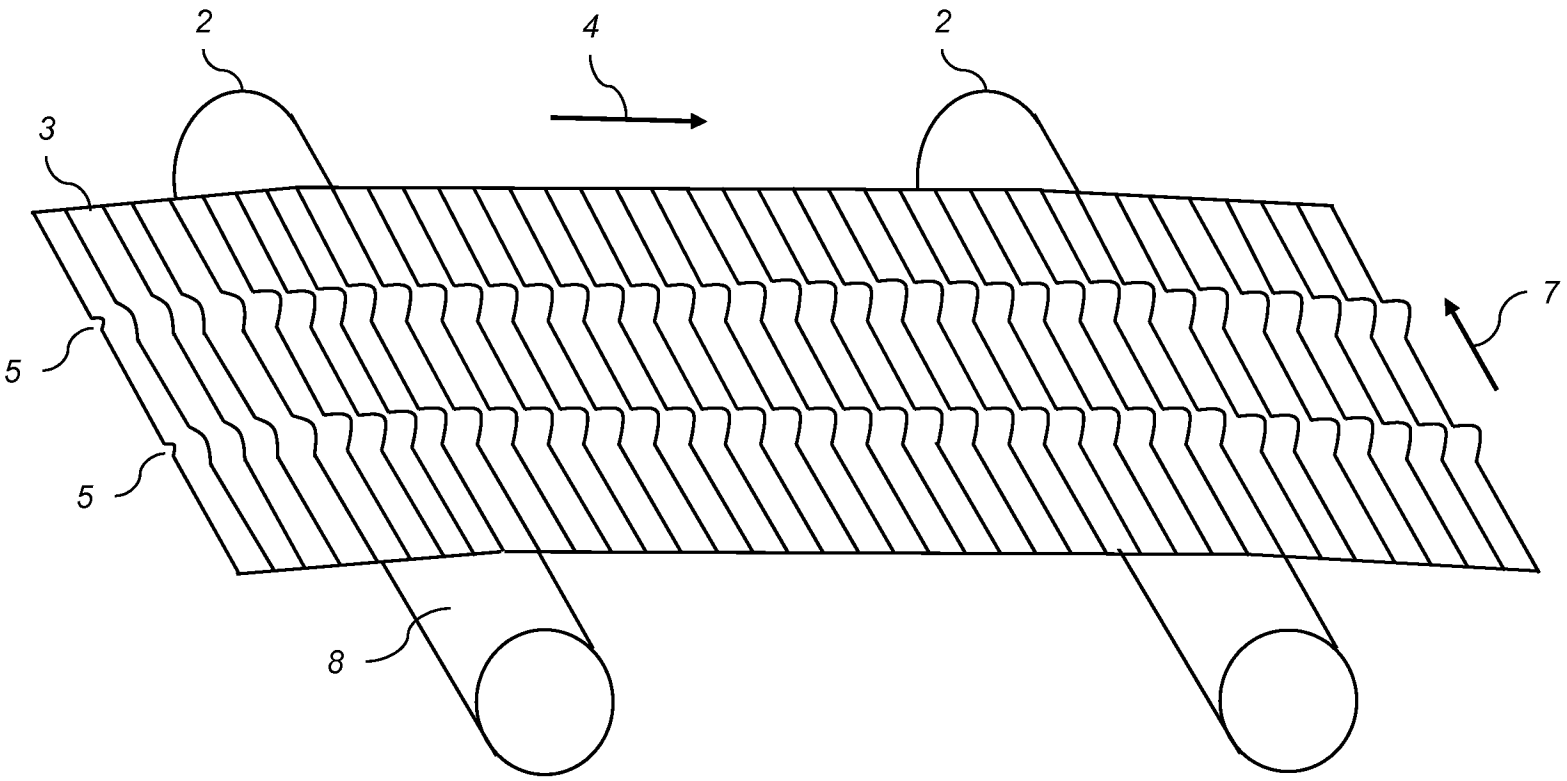
FIG. 1 (Prior Art)
FIG. 1 illustrates the formation of flutes in a continuous web of receiver media due to cross-track expansion of the receiver media.

The present description will be directed in particular to elements forming part of, or cooperating more directly with, an apparatus in accordance with the present invention. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. It should be noted that, unless otherwise explicitly noted or required by context, the word "or" is used in this disclosure in a non-exclusive sense.

The example embodiments of the present invention are illustrated schematically and not to scale for the sake of clarity. One of ordinary skill in the art will be able to readily determine the specific size and interconnections of the elements of the example embodiments of the present invention.

As described herein, the exemplary embodiments of the present invention provide a printhead or printhead components typically used in inkjet printing systems. However, many other applications are emerging which use inkjet printheads to emit liquids (other than inks) that need to be finely metered and deposited with high spatial precision. Such liquids include inks, both water based and solvent based, that include one or more dyes or pigments. These liquids also include various substrate coatings and treatments, various medicinal materials, and functional materials useful for forming, for example, various circuitry components or structural components. As such, as described herein, the terms "liquid" and "ink" refer to any material that is ejected by the printhead or printhead components described below.

Inkjet printing is commonly used for printing on paper, however, there are numerous other materials in which inkjet is appropriate. For example, vinyl sheets, plastic sheets, textiles, paperboard and corrugated cardboard can comprise the receiver media. Additionally, although the term inkjet is often used to describe the printing process, the term jetting is also appropriate wherever ink or other liquids is applied in a consistent, metered fashion, particularly if the desired result is a thin layer or coating.

Inkjet printing is a non-contact application of an ink to a receiver media. Typically, one of two types of ink jetting mechanisms are used and are categorized by technology as either drop-on-demand inkjet or continuous inkjet.

Drop-on-demand ink jet printing, provides ink drops that impact upon a recording surface using a pressurization actuator, for example, a thermal, piezoelectric or electrostatic actuator. One commonly practiced drop-on-demand inkjet type uses thermal energy to eject ink drops from a nozzle. A heater, located at or near the nozzle, heats the ink sufficiently to form a vapor bubble that creates enough internal pressure to eject an ink drop. This form of inkjet is commonly termed "thermal ink jet." A second commonly practiced drop-on-demand inkjet type uses piezoelectric actuators to change the volume of an ink chamber to eject an ink drop.

The second technology commonly referred to as "continuous" ink jet printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous inkjet printing type uses thermal stimulation of the liquid jet with a heater to form drops that eventually become printing drops and non-printing drops. Printing occurs by selectively deflecting either the printing drops or the non-printing drops and catching the non-printing drops using catchers. Various approaches for selectively deflecting drops have been developed including electrostatic deflection, air deflection, and thermal deflection.

There are typically two types of receiver media used with inkjet printing systems. The first type of receiver media is in the form of a continuous web, while the second type of receiver media is in the form of cut sheets. The continuous web of receiver media refers to a continuous strip of receiver media, generally originating from a source roll. The continuous web of receiver media is moved relative to the inkjet printing system components using a web transport system, which typically include drive rollers, web guide rollers, and web tension sensors. Cut sheets refer to individual sheets of receiver media that are moved relative to the inkjet printing system components via rollers and drive wheels or via a conveyor belt system that is routed through the inkjet printing system.

The invention described herein is applicable to both drop-on-demand and continuous inkjet printing technologies that print on continuous webs of receiver media. As such, the term "printhead" as used herein is intended to be generic and not specific to either technology. Additionally, the invention described herein is also applicable to other types of printing systems, such as offset printing and electrophotographic printing, that print on continuous webs of receiver media.

The terms "upstream" and "downstream" are terms of art referring to relative positions along the transport path of the receiver media; points on the receiver media move along the transport path from upstream to downstream.

Figure 2:
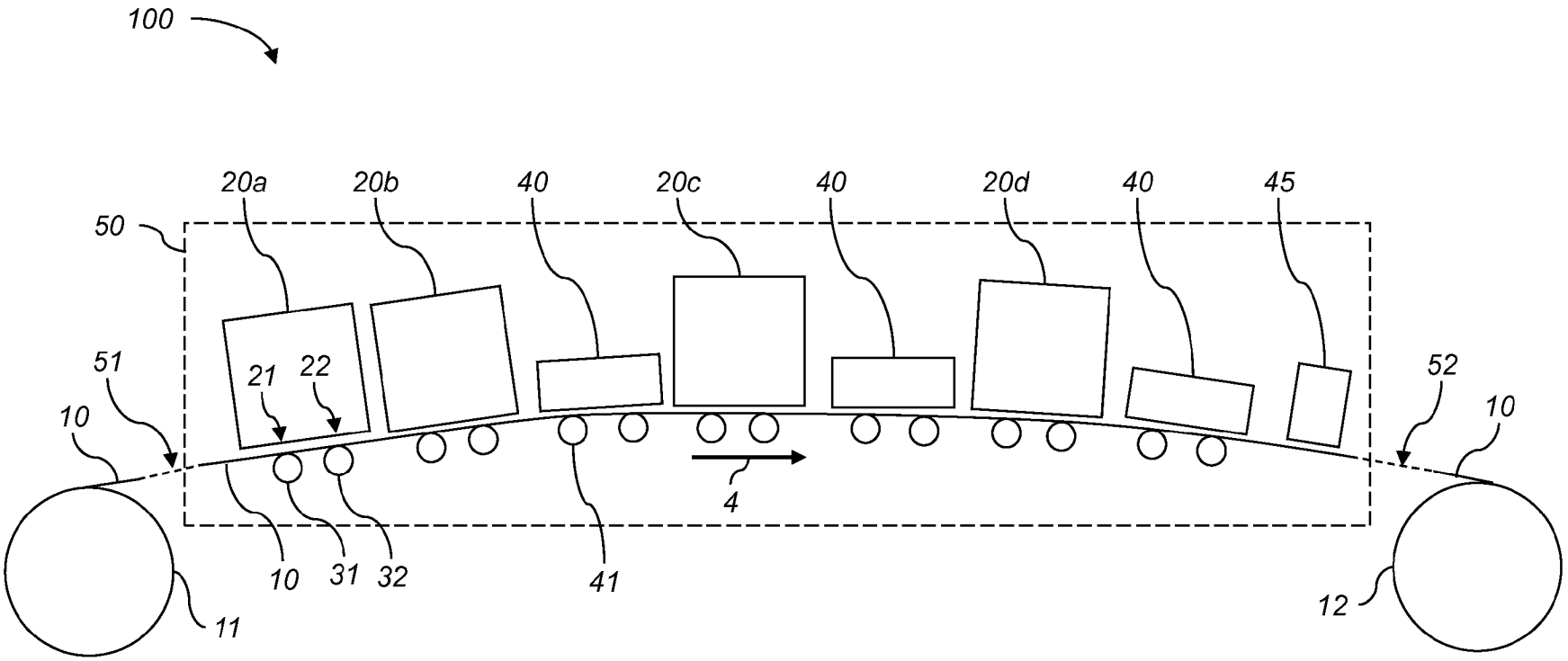
FIG. 2 is a simplified side view of an inkjet printing system.

Referring to FIG. 2, there is shown a simplified side view of a portion of a digital printing system 100 for printing on a first side of a continuous web of receiver media 10. The printing system 100 includes a printing module 50 which includes printheads 20*a*, 20*b*, 20*c*, 20*d*, dryers 40, and a quality control sensor 45. In this exemplary system, the first printhead 20*a* jets cyan ink, the second printhead 20*b* jets magenta ink, the third printhead 20*c* jets yellow ink, and the fourth printhead 20*d* jets black ink. Below each printhead 20*a*, 20*b*, 20*c*, 20*d* is a media guide assembly including print line rollers 31 and 32 that guide the continuous web of receiver media 10 past a first print line 21 and a second print line 22 as the receiver media 10 is advanced along a media path in the in-track direction 4. Below each dryer 40 is at least one dryer roller 41 for controlling the position of the web of receiver media 10 near the dryers 40. Receiver media 10 originates from a source roll 11 of unprinted receiver media 10, and printed receiver media 10 is wound onto a take-up roll 12. Other details of the printing module 50 and the printing system 100 are not shown in FIG. 2 for simplicity. For example, to the left of printing module 50, a first zone 51 (illustrated as a dashed line region in receiver media 10) can include a slack loop, a web tensioning system, an edge guide and other elements that are not shown. To the right of printing module 50, a second zone 52 (illustrated as a dashed line region in receiver media 10) can include a turnover mechanism and a second printing module similar to printing module 50 for printing on a second side of the receiver media 10.

Figure 3:
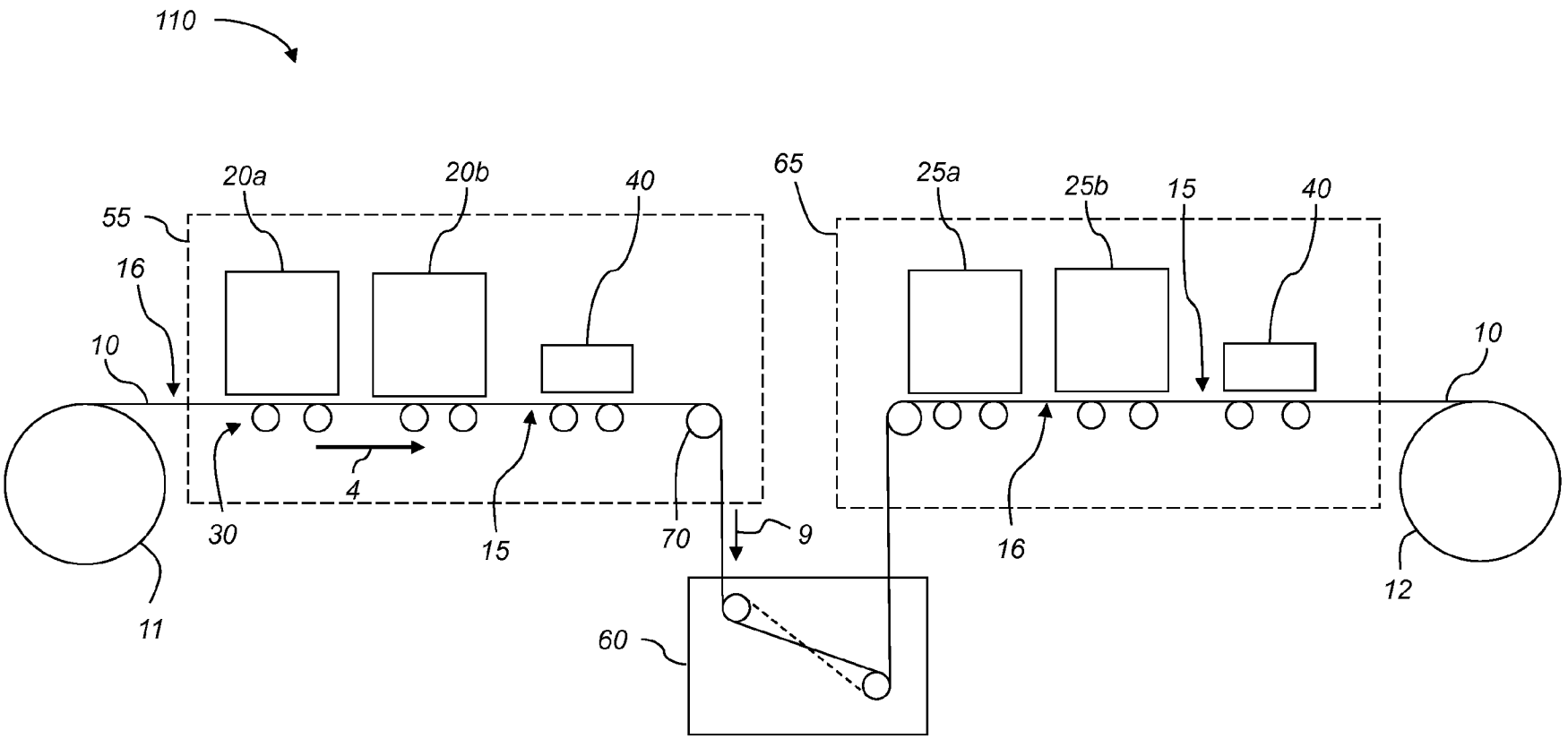
FIG. 3 is a simplified side view of an inkjet printing system for printing on both sides of a web of receiver media.

Referring to FIG. 3, there is shown a simplified side view of a portion of a printing system 110 for printing on both a first side 15 and a second side 16 of a continuous web of receiver media 10. Printing system 110 includes a first printing module 55 having two printheads 20*a*, 20*b* and a dryer 40; a turnover mechanism 60; and a second printing module 65 having two printheads 25*a* and 25*b* and a dryer 40. A web guiding system 30 guides the web of receiver media 10 from upstream to downstream along a transport path in an in-track direction 4 past printheads 20*a* and 20*b* and dryer 40 in printing module 55 for printing on the second side 16 of the receiver media 10. The web guiding system 30 includes a web-guiding structure 70, which can be a roller for example, positioned near the exit of first printing module 55 for redirecting a direction of travel of the web of receiver media 10 along exit direction 9 in order to guide web of receiver media 10 toward the turnover mechanism 60. The first side 15 of web of receiver media 10 is in contact with at least some portions of an exterior surface of the web-guiding structure 70.

Figure 4:
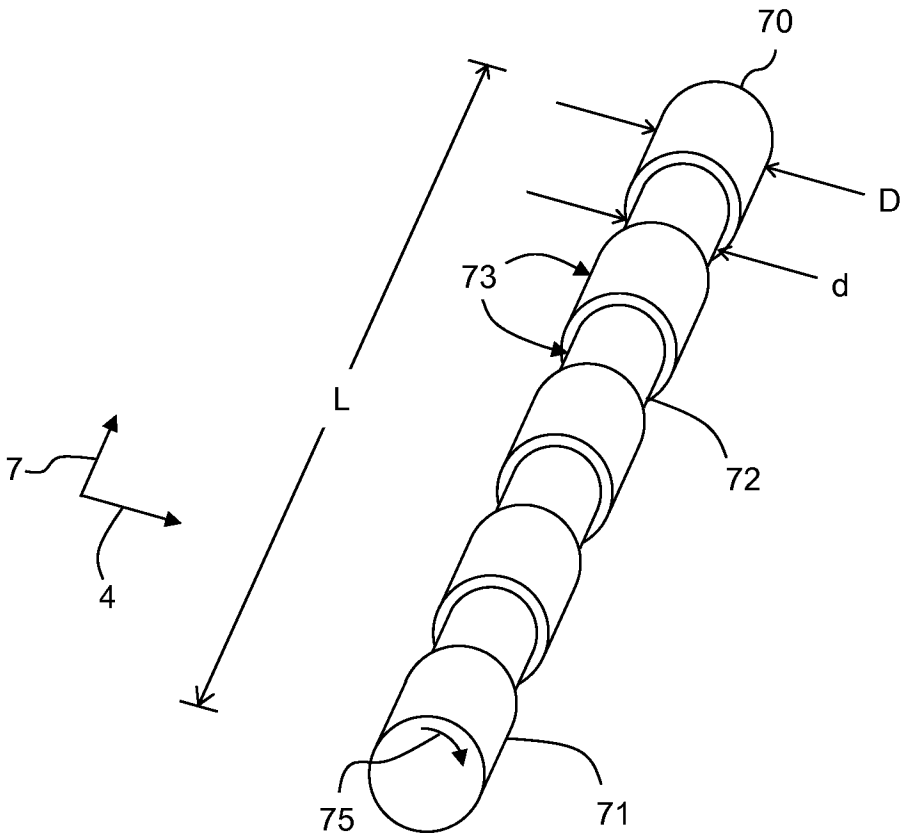
FIG. 4 is a perspective of a web-guiding structure having ridges and recesses.

Commonly assigned, U.S. Pat. No. 8,303,106 to C. Kasiske et. al., entitled "Printing system including web media moving apparatus", which is incorporated herein by reference, discloses a roller for use as a web-guiding structure having a pattern of recesses and ridges positioned along its axis of rotation. FIG. 4 shows a perspective of an example of a web-guiding structure 70 similar to that described in U.S. Pat. No. 8,303,106 having ridges 71 and recesses 72 alternately disposed along its length. The web-guiding structure 70 extends along a length L that is parallel to cross-track direction 7 and provides a curved exterior surface 73 having a cylindrical shape. The diameter of the exterior surface 73 of web-guiding structure 70 varies along length L to form a pattern of ridges 71 and recesses 72. In particular, the diameter of exterior surface 73 at a ridge 71 is D, and the diameter of exterior surface 73 at a recess 72 is d, where d<D. In this example, each recess 72 is a groove in the web-guiding structure 70, where the grooves extend around at least a portion of the exterior surface 73 and are parallel to the in-track direction 4. The grooves that form the recesses 72 can be equally spaced or non-equally spaced.

In some embodiments, the web-guiding structure 70 is a roller that rotates in rotation direction 75, either being driven by a motor (not shown) or being passively rotated by the web moving in contact with the exterior surface 73 of the web-guiding structure 70, and particularly the exterior surface 73 of the ridges 71. The recesses 72 provide regions for the web of receiver media 10, which has undergone dimensional changes due to ink deposition by printheads 20*a*, 20*b*, 20*c*, 20*d* and by dryers 40 (FIG. 3), to fit into as web of receiver media 10 wraps around web-guiding structure 70. This reduces the likelihood of the receiver media 10 wrinkling as it wraps around web-guiding structure 70.

Figure 5A:
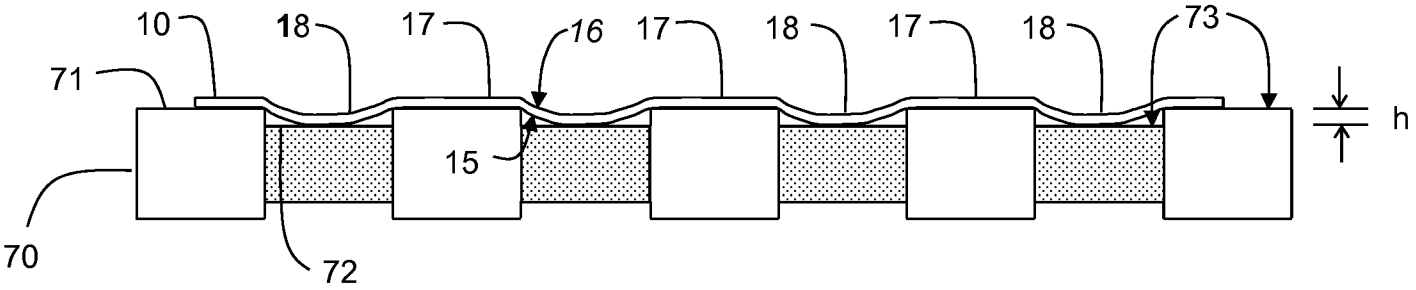
FIG. 5A is a side view of a web-guiding structure where portions of the web of receiver media extend into recesses in the web-guiding structure.

FIG. 5A shows a side view of web-guiding structure 70 where some receiver media portions 17 are in contact with the exterior surface 73 of the ridges 71, and other receiver media portions 18 extend into the recesses 72. The extent to which the receiver media portions 18 can be accommodated in the recesses 72 is limited by the first side 15 of the receiver media 10 contacting the bottoms (i.e., the exterior surfaces 73) of recesses 72, which is related to the depth h of recesses 72.

Figure 5B:
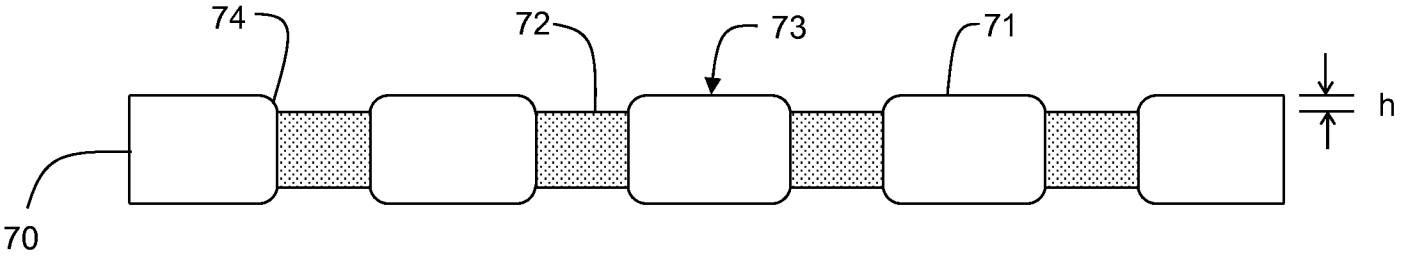
FIG. 5B is a side view of a web-guiding structure having recesses with rounded edges.

FIG. 5B shows a side view of a web-guiding structure 70 where the recesses 72 have rounded edges 74 where they meet the exterior surface 73 of the ridges 71 of the web-guiding structure 70. Such rounded edges 74 provide a lower concentration of stress on web of receiver media 10 (FIG. 5A).

Figure 6:
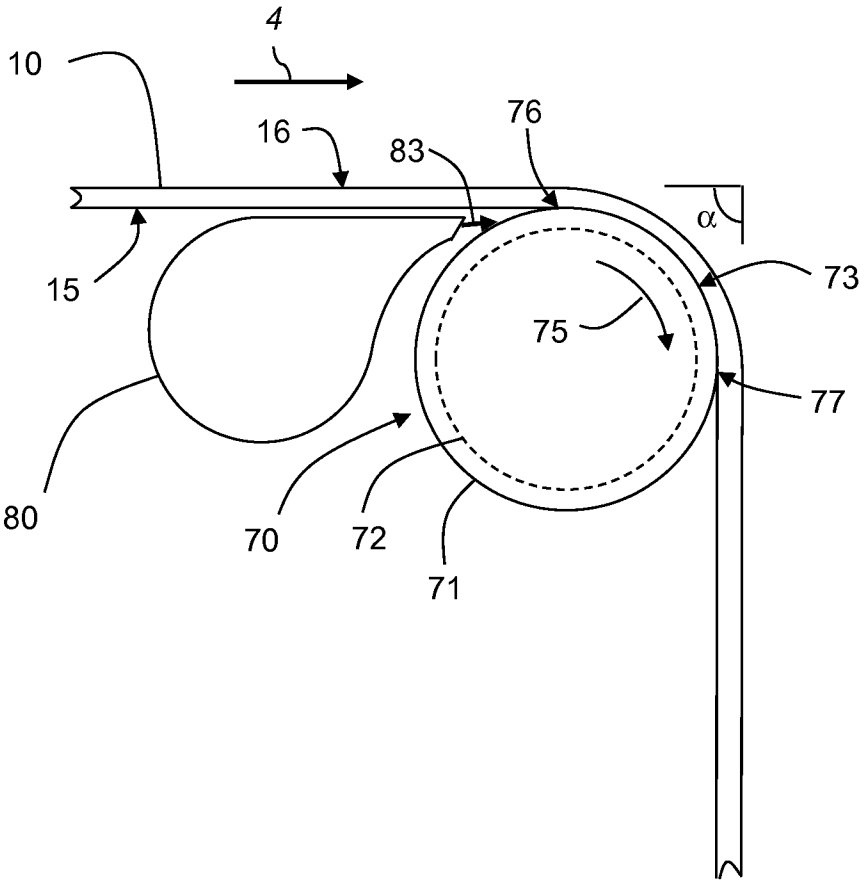
FIG. 6 is an end view of a web-guiding system including an air source for providing an air flow between a web-guiding structure and the web of receiver media.
Figure 7:
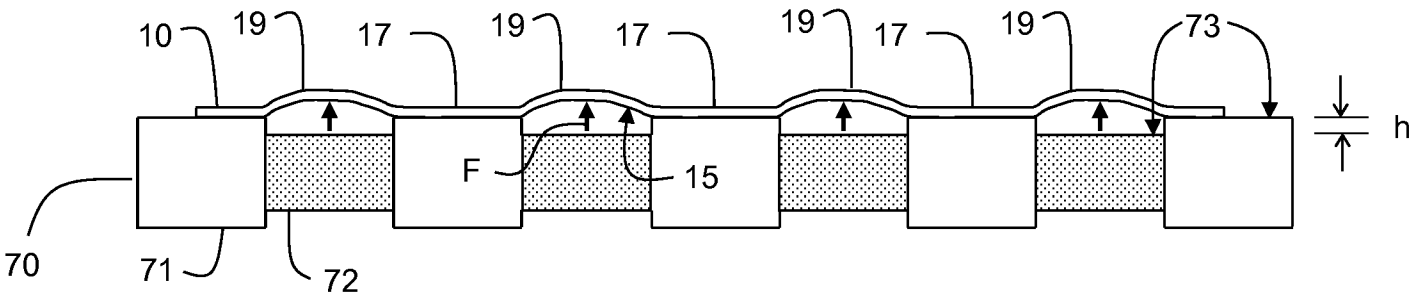
FIG. 7 is a side view of a web-guiding structure showing portions of the web of receiver media overlying the recesses being lifted up by the air flow.

According to embodiments of the invention, with reference to the end view of FIG. 6 and the side view of FIG. 7, an air source 80, such as a blower, provides an air flow 83 between the first side 15 of the web of receiver media 10 and the exterior surface 73 of the web-guiding structure 70 in order to provide a lifting force F to lift receiver media portions 19 that are disposed over the recesses 72 away from the exterior surface 73 of web-guiding structure 70.

FIG. 6 shows the wrap angle $\alpha$ of the web of receiver media 10 around web-guiding structure 70. In the examples shown in FIGS. 3 and 6, the wrap angle $\alpha$ is approximately equal to 90 degrees. Wrap angle $\alpha$ corresponds to the amount of redirection of travel of the web of receiver media 10 by the web-guiding structure 70. The wrap of the web of receiver media 10 around web-guiding structure 70 extends from an entry contact boundary 76 to an exit contact boundary 77. Although in the illustrated example wrap angle $\alpha$ is about 90 degrees, more generally the invention is applicable to web-guiding systems where the direction of travel of the web of media is redirected by any amount (e.g., between 2 degrees and 200 degrees) as it travels along the transport path past web-guiding structure 70.

In order to reduce stress on web of receiver media 10, the exterior surface 73 of web-guiding structure 70 is preferably curved, particularly the exterior surface 73 of ridges 71. In some embodiments, the exterior surface 73 of web-guiding structure 70 has a cylindrical shape with a circular cross-section as shown in FIG. 4, whether web-guiding structure 70 is a rotating roller or a fixed and non-rotating structure.

Figure 8:
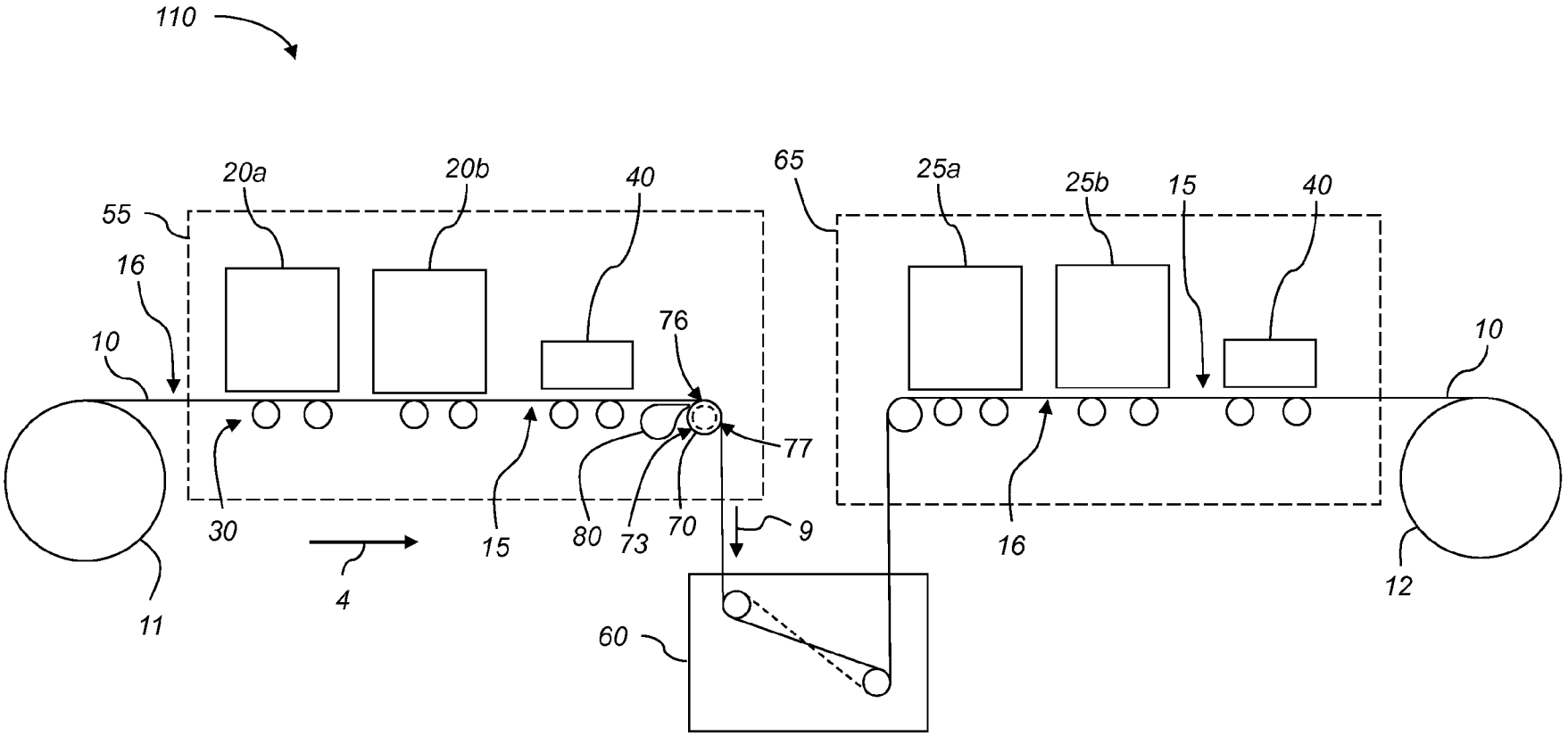
FIG. 8 shows an inkjet printing system similar to FIG. 3 that includes a web-guiding system having an air source positioned upstream of the web-guiding structure.

FIG. 8 shows a simplified side view of a portion of a printing system 110 according to an embodiment of the present invention, which is similar to FIG. 3, but includes the air source 80 for providing an air flow 83 (FIG. 6) between the first side 15 of receiver media 10 and the exterior surface 73 of the web-guiding structure 70 as described above with reference to FIGS. 6 and 7.

Figure 9A:
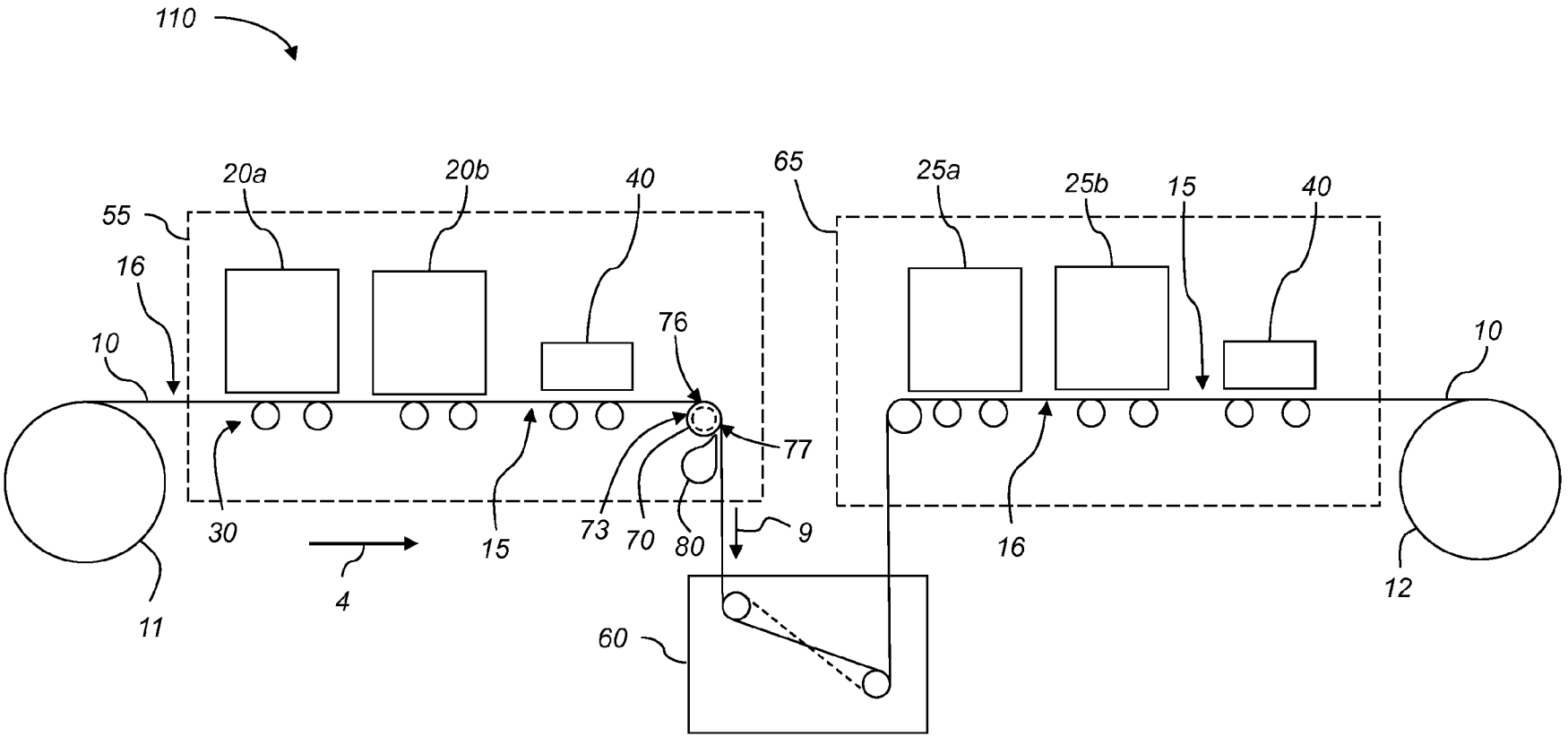
FIG. 9A shows an inkjet printing system similar to FIG. 3 that includes a web-guiding system having an air source positioned downstream of the web-guiding structure.

In the examples of FIGS. 6 and 8 the air source 80 is located upstream of web-guiding structure 70 and blows air between the first side 15 of the receiver media 10 and the exterior surface 73 of the web-guiding structure 70 along entry contact boundary 76 where the receiver media 10 first comes into contact with the web-guiding structure 70. FIG. 9A shows a configuration similar to that of FIG. 8 except that the air source 80 is located downstream of the web-guiding structure 70 and blows air between the first side 15 of the receiver media 10 and the exterior surface 73 of the web-guiding structure 70 along the exit contact boundary 77 where the web of receiver media 10 leaves contact with the web-guiding structure 70.

Figure 9B:
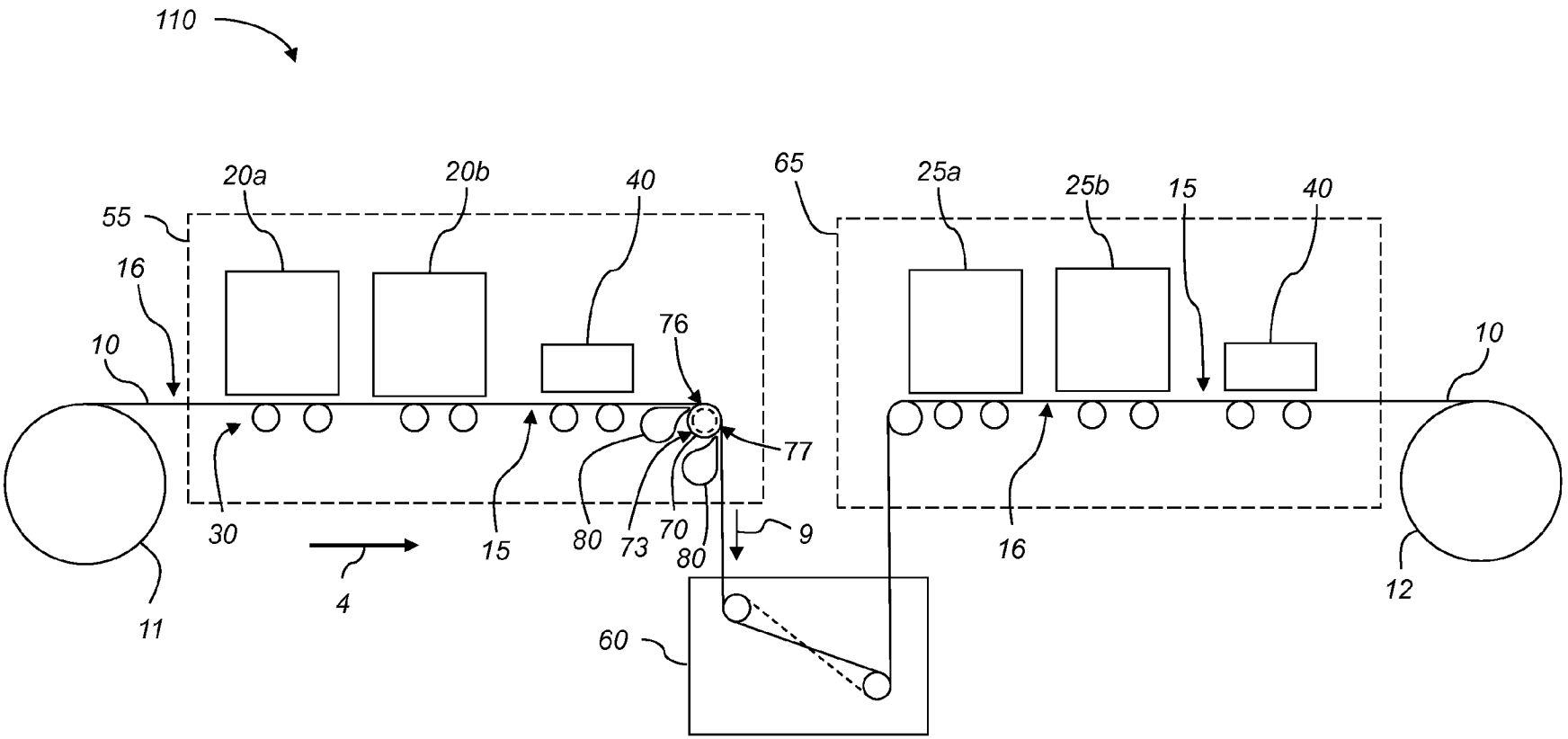
FIG. 9B shows an inkjet printing system similar to FIG. 3 that includes a web-guiding system having air sources positioned both upstream and downstream of the web-guiding structure.

As shown in FIG. 9B, in some embodiments air sources 80 can be positioned on both the upstream side of the web-guiding structure (as in FIG. 8) and on the downstream side of the web-guiding structure (as in FIG. 9), with both air sources directing air between the first side 15 of the receiver media 10 and the exterior surface 73 of the web-guiding structure 70 from respective sides. This can provide an increased lifting force relative to the single air source configurations shown in FIGS. 8 and 9A by providing additional air flow, and by also helping to increase air pressure by the counteracting effects of the two air sources.

Figure 10:
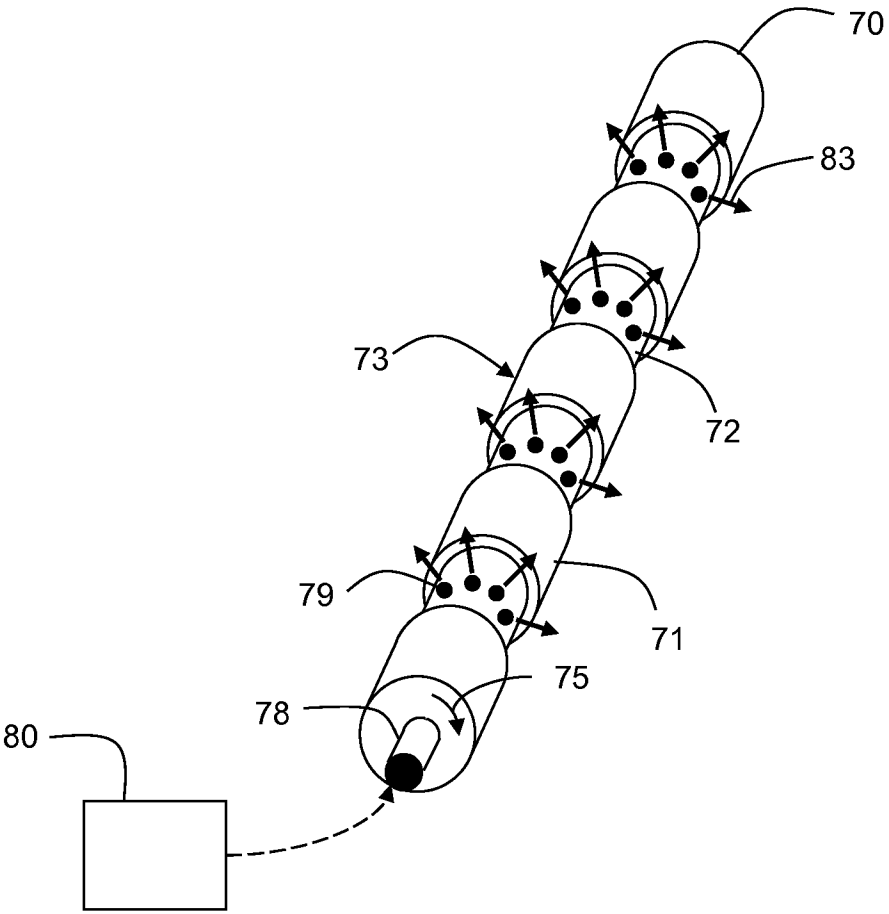
FIG. 10 shows a perspective of a web-guiding structure where air flow is provided through air holes in the recesses.

FIG. 10 shows a perspective of an alternate embodiment of a web-guiding structure 70. Air from air source 80 is directed through an air inlet 78, typically by a hose (not shown) and is forced through air holes 79 in web-guiding structure 70 to provide air flow 83. The air holes 79 are preferably aligned with recesses 72, so that the air blowing through air holes 79 onto the first side 15 of the receiver media 10 provides a lifting force F to lift receiver media portions 19 (FIG. 7) overlying the recesses 72 away from the web-guiding structure 70.

Figure 11A:
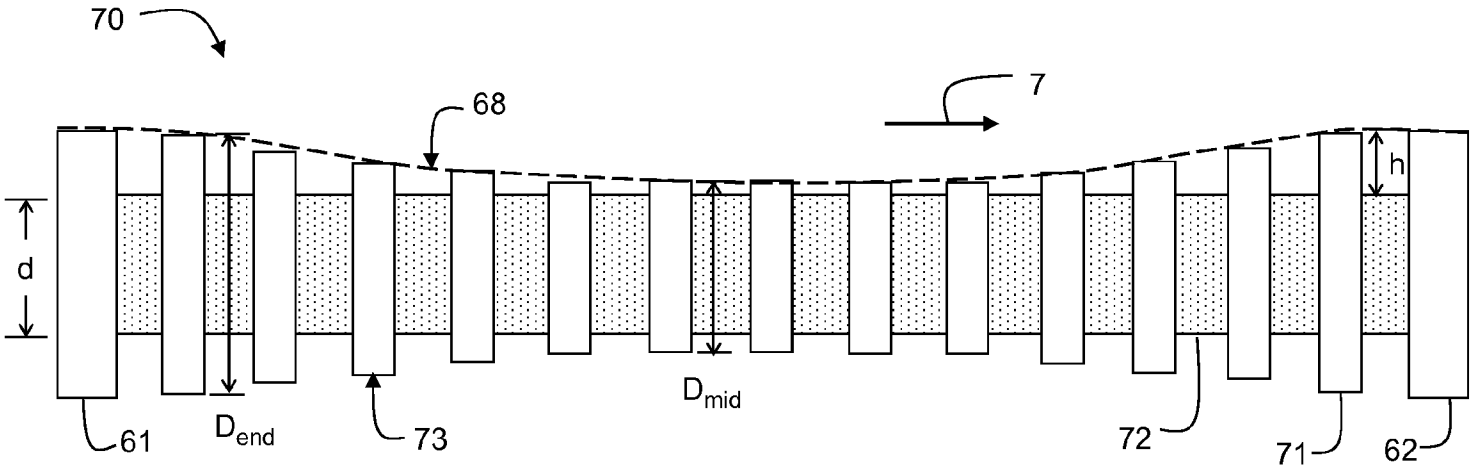
FIG. 11A is a side view of a web-guiding structure whose ridges provide a concave surface profile.
Figure 11B:
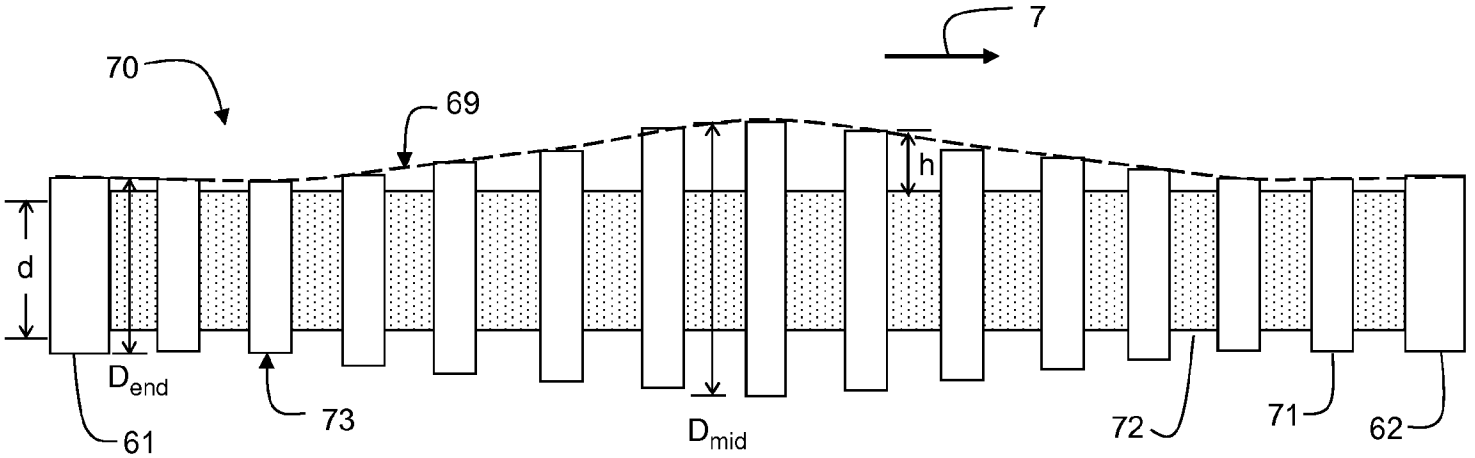
FIG. 11B is a side view of a web-guiding structure whose ridges provide a convex surface profile.

In the examples shown in FIG. 5A, the ridges 71 are shown as with a constant outer diameter so that the exterior surface 73 of the ridges 71 has a uniform profile. However, this is not a requirement. In some embodiments, it can be desirable that the diameter of the exterior surface 73 of the ridges 71 varies along the length of the web-guiding structure 70. FIG. 11A shows a side view of an exemplary web-guiding structure 70 where the diameter of the ridges 71 is varied to provide a concave surface profile 68, while FIG. 11B shows a side view of another exemplary web-guiding structure 70 where the diameter of the ridges 71 is varied to provide a convex profile. For both web-guiding structures the diameter d of the recessed regions corresponding to recesses 72 is constant, although this is not required. For the concave surface profile 68 of the web-guiding structure in FIG. 11A, the diameters $D_{end}$ of the ridges 71 near a first end 61 and a second end 62 are larger than the diameters $D_{mid}$ of the ridges 71 near a middle of the web-guiding structure 70. For the convex surface profile 69 of the web-guiding structure of FIG. 11B, the diameters $D_{end}$ of the ridges 71 near the first end 61 and the second end 62 are smaller than the diameters $D_{mid}$ of the ridges 71 near the middle of the web-guiding structure 70. In some embodiments the diameter of the exterior surface 73 can vary within a particular ridge 71 to provide a continuous surface profile as shown in FIG. 6 of the aforementioned U.S. Pat. No. 8,303,106. (Note that the concave surface profile 68 in FIG. 11A and the convex surface profile 69 in FIG. 11B are shown with a relatively large depth h for illustration purposes, and are not necessarily representative of actual web-guiding structure 70 surface profiles.)

It is known that a rotating roller having a contoured surface profile (as in FIGS. 11A-11B) can provide lateral forces on the web of receiver media 10 to spread or stretch the web of receiver media 10 in the cross-track direction 7, thereby helping to compensate for cross-track expansion caused by absorption of water-based ink. The appropriate shape of the surface profile will depend on the traction of the receiver media 10 around the web-guiding structure 70. The amount of traction will depend on a variety of factors including the surface properties of the web-guiding structure 70 and the receiver media 10, the tension of the receiver media 10, and the wrap angle $\alpha$ (FIG. 6). A concave surface profile 68 (as in FIG. 11A) is generally appropriate for low-traction configurations (e.g., for wrap angles $\alpha$ that are only a few degrees), and a convex surface profile 69 (as in FIG. 11B) is generally appropriate for high-traction configurations (e.g., for wrap angles $\alpha$ that are larger than about 10 degrees).

Because the diameter of the ridges 71 varies while the diameter of the recesses remains constant in both FIGS. 11A and 11B, the depth h of the recesses varies across a cross-track direction 7 for the web-guiding structures 70 shown in both examples. In other embodiments (not shown) the diameter of the recessed regions corresponding to recesses 72 can also be varied such that the depth h of the recesses is constant along the cross-track direction. In some embodiments, the depths of recesses 72 can be adjusted along the length of the web-guiding structure 70 to control the magnitude of lifting force F (FIG. 7) across the width of the receiver media 10.

In the exemplary web-guiding structure 70 of FIG. 4, which is also shown in a side view in FIG. 5A, the recesses 72 are grooves that extend around the exterior surface 73 of the web-guiding structure 70 in a direction parallel to the in-track direction 4. Such a configuration results in alternating ridges 71 and recesses 72 where adjacent recesses 72 are isolated from each other by an intervening ridge 71. The recesses 72 can be equally spaced as shown in FIG. 4, or alternately they can be non-equally spaced (not shown). Additionally, the grooves can have equal widths as shown in FIG. 4, or they can have unequal widths (not shown). In various embodiments, the width and spacing of the recesses 72, as well as the depth of the recesses 72, can be used to control the magnitude of the lifting force F (FIG. 7) across the width of the receiver media 10. Larger magnitudes of the lifting force can be provided in regions where the receiver media 10 is more prone to wrinkling. More lifting force is achieved by smaller recess depth or increased recess width In some embodiments, the ridges 71 can be repositionable rings that can be moved along a central shaft and fastened in desired positions (e.g., with set screws). In this case, the exterior surface 73 of the recesses 72 corresponds to the outer surface of the central shaft. In this way, the web-guiding structure 70 can conveniently be reconfigured for use with different receiver media widths (e.g., to ensure that the edges of the receiver media 10 are supported by a ridge), or to adjust the magnitude of the lifting force F provided at different positions along the length of the web-guiding structure (e.g., by adjusting the width of the recesses 72).

In some embodiments, the web-guiding structure 70 can also be reconfigured in accordance with image content printed on the receiver media 10. For example, the dimensions of the receiver media 10 will generally vary the most in regions where the most amount of ink is applied, causing the receiver media 10 to expand. Therefore, it can be desirable to provide higher magnitudes of lifting force F for those regions of the receiver media 10 which have been printed with the highest ink amounts.

Figure 12:
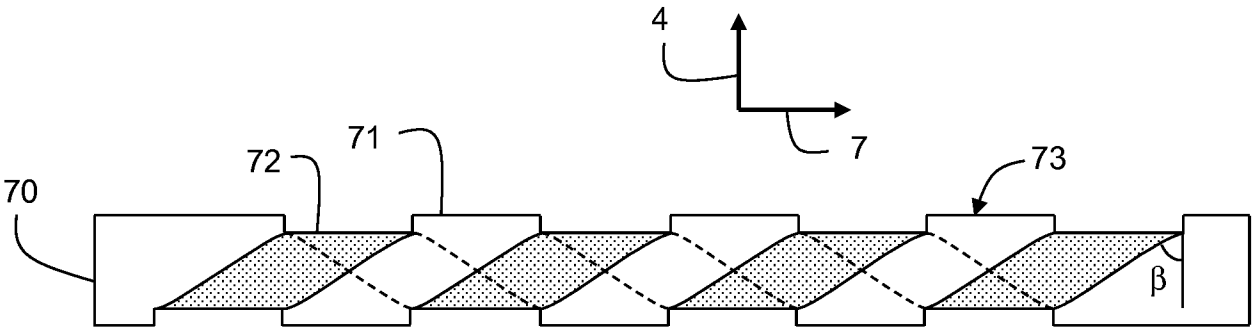
FIG. 12 shows a web-guiding structure where the recesses are grooves that are skewed relative to the in-track direction.

FIG. 12 shows a top view of a web-guiding structure 70 where the recesses 72 are grooves that are skewed with a skew angle β relative to the in-track direction 4. In some embodiments, the grooves are formed as one or more continuous helical grooves that extend around the diameter of the web-guiding structure (similar to screw threads) so that the recesses 72 are actually connected with each other. Herein it will be considered that the term "plurality of grooves" includes the case of a single continuous helical groove that forms recesses 72 along the length of the web-guiding structure 70.

As described above with reference to FIG. 4, in some embodiments the web-guiding structure 70 can be a rotating roller. In other embodiments, the web-guiding structure 70 can be a fixed structure having an exterior surface 73 facing the web of receiver media 10, where the exterior surface 73 has a pattern of ridges 71 and recesses 72. One such fixed web-guiding structure 70 would be a fixed, non-rotating roller, but other types of fixed media supports can also be used in accordance with the invention.

Figure 13:
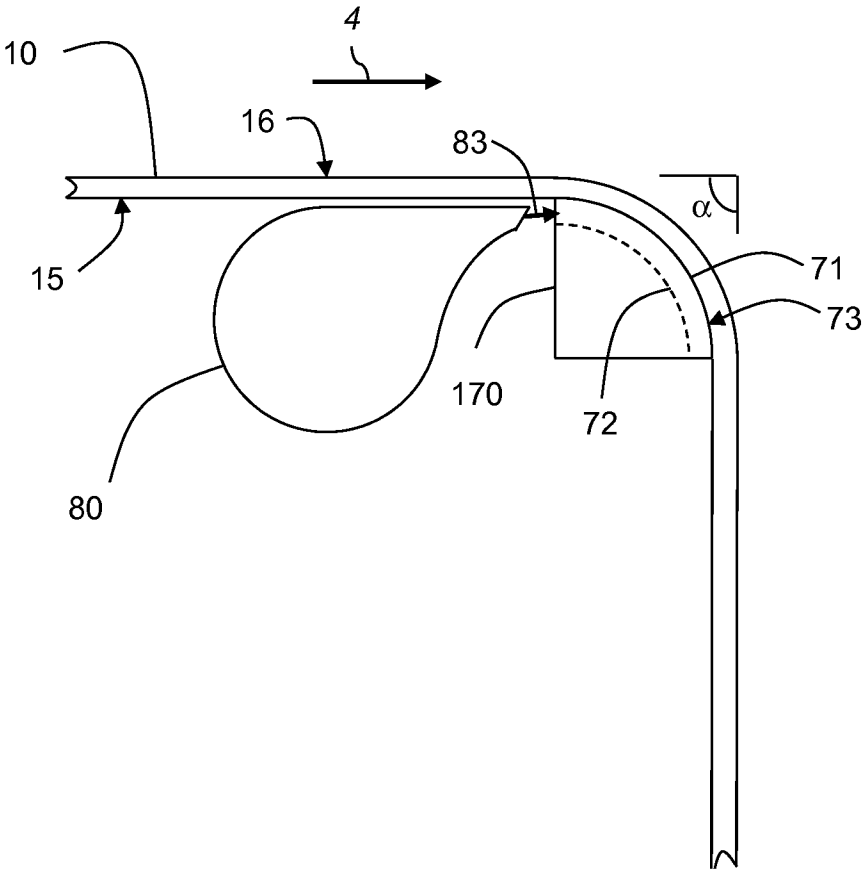
FIG. 13 shows an end-view of a web-guiding system including a blower positioned upstream of a fixed media support according to an embodiment of the invention.

FIG. 13 shows an example of a non-rotating, fixed web-guiding structure 170 similar to the web-guiding structure 70 shown in FIG. 6, but where the fixed web-guiding structure 170 has a non-circular cross-section. As in FIGS. 6 and 7, an air source 80, such as a blower, provides an air flow 83 between the first side 15 of the web of receiver media 10 and an exterior surface 73 of the fixed web-guiding structure 170 in order to provide a lifting force F to lift receiver media portions 19 that are disposed over the recesses 72 away from the exterior surface 73 of web-guiding structure 70. In this example, the exterior surface 73 of the fixed web-guiding structure 170 that faces the web of receiver media 10 has an arc-shaped cross-section, and the recesses 72 are grooves that extend around the exterior surface 73 in a direction parallel to the in-track direction 4.

With a fixed web-guiding structure 170, the web of receiver media 10 will slide past the exterior surface 73 in contact with the ridges 71. Consequently, such configurations are most appropriate for cases where the fixed web-guiding structure 70 contacts a non-printed side of the receiver media 10. For cases where a printed side of the receiver media 10 contacts the exterior surface 73 before the ink has fully dried, it will generally be preferable to use a rotating web-guiding structure 70, such as that shown in FIG. 6.

In order to reduce drag on the web of receiver media 10 and improve the wear resistance of the fixed web-guiding structure 170, the exterior surface 73 is preferably fabricated using a material having a coefficient of friction that is less than 0.2. The fixed web-guiding structure 170 can be made entirely of a low friction material such as polytetrafluoroethylene (also known as PTFE or by its trademarked name of TEFLON). Alternatively, the fixed web-guiding structure 170 can be made of a material such as stainless steel and the exterior surface can be polished and coated with a low friction material such as PTFE or thin film diamond-like carbon.

Figure 14:
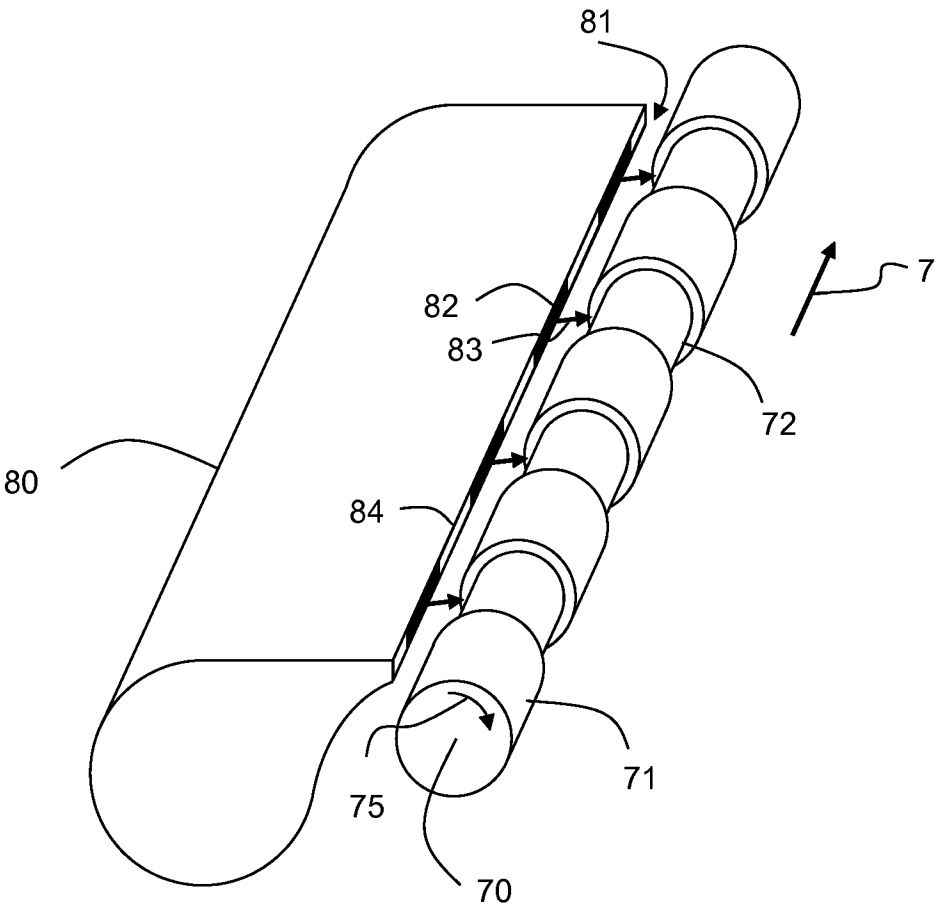
FIG. 14 shows a perspective of an air source having a manifold for providing an air flow that varies across the cross-track direction.

In some embodiments, the air flow 83 provided by the air source 80 (FIG. 6) is uniform across the length of the web-guiding structure 70 (or the fixed web-guiding structure 170 in FIG. 13). In other embodiments, the air source 80 provides an air flow 83 that varies along the cross-track direction 7 of the web-guiding structure 70. FIG. 14 shows a perspective of an exemplary embodiment in which the air source 80 has a manifold 81 having openings 82 that are aligned with recesses 72 to vary the air flow 83 such that it is preferentially directed to the portions of the web of receiver media 10 overlying the recesses 72. The manifold 81 includes blockages 84 that are interspersed between openings 82 to block air flow in cross-track positions corresponding to the ridges 71.

In some embodiments, at least some of the blockages 84 are sliding doors that can be repositioned to adjust the air flow profile. For example, the blockages 84 toward an end of manifold 81 can be opened or closed to adjust the air flow profile of the adjustable manifold 81 in accordance with a cross-track width of the web of receiver media 10. In other embodiments, the amount of air flow 83 can be greater or less through openings 82 near the ends of web-guiding structure 70 relative to the amount of air flow 83 through openings 82 near the center of the web-guiding structure 70 in order to provide a varying amount of lifting force F across the web of receiver media 10.

In some embodiments, the blockages 84 can also be reconfigured in accordance with image content printed on the receiver media 10. For example, the dimensions of the receiver media 10 will generally vary the most in regions where the most amount of ink is applied, causing the receiver media 10 to expand. Therefore, it can be desirable to provide higher magnitudes of air flow 83 (and corresponding higher magnitudes of the lifting force F) for those regions of the receiver media 10 which have been printed with the highest ink amounts.

Figure 15:
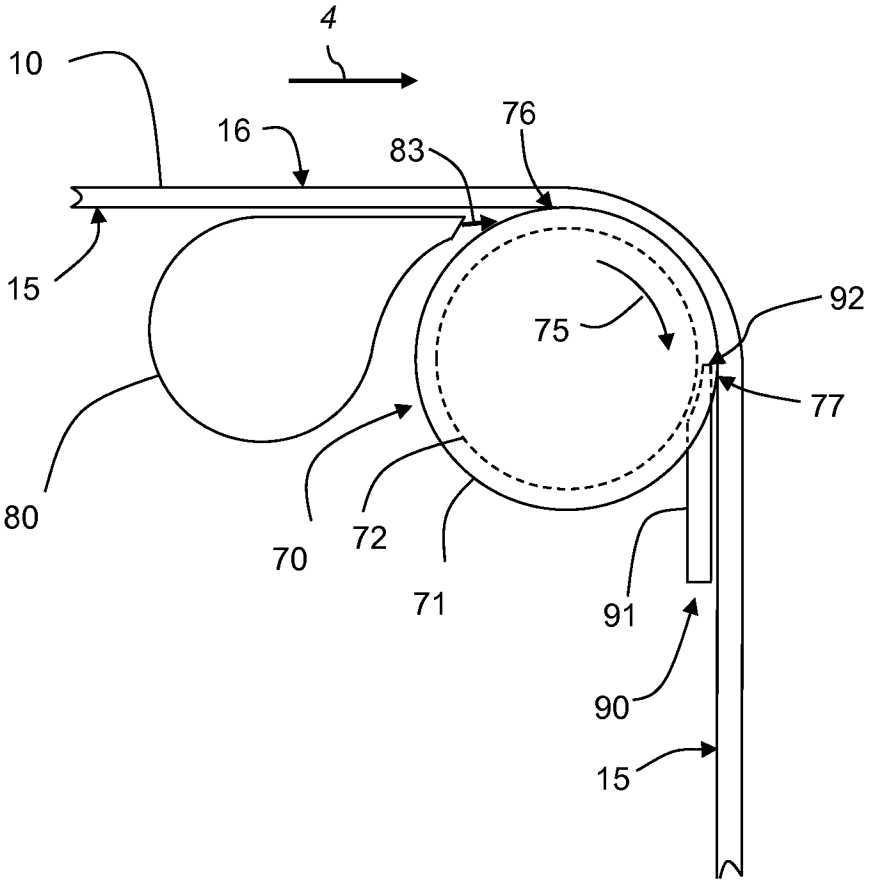
FIG. 15 shows an end view of a web-guiding system similar to FIG. 6 including fingers that serve as air restrictors positioned opposite to the air source.

In some embodiments an air restrictor 90 can be positioned on an opposite side of the web-guiding structure 70 from the air source 80 as shown in FIGS. 15-20. The purpose of the air restrictor 90 is to restrict the air flow 83 that passes through the recesses 72 between the first side 15 of the web of receiver media 10 and the exterior surface 73 of the web-guiding structure 70 so that air pressure builds up between the receiver media 10 and the web-guiding structure 70 and provides an increased lifting force F (FIG. 7). With reference also to FIG. 15, if the air source 80 is positioned near the entry contact boundary 76 between web of receiver media 10 and web-guiding structure 70, the air restrictor 90 is preferably be positioned near the exit contact boundary 77. Correspondingly, if air source 80 is positioned near the exit contact boundary 77 (as in FIGS. 9A and 9B), the air restrictor 90 would preferably be positioned near the entry contact boundary 76.

Figure 17:
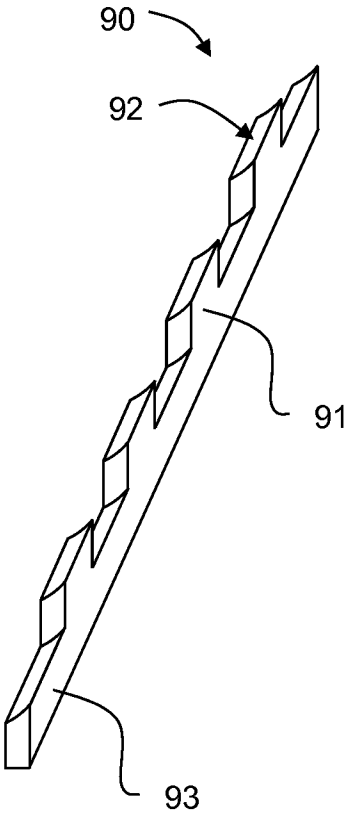
FIG. 17 shows a perspective of a comb support member for the air restrictor fingers of FIG. 16.
Figure 16:
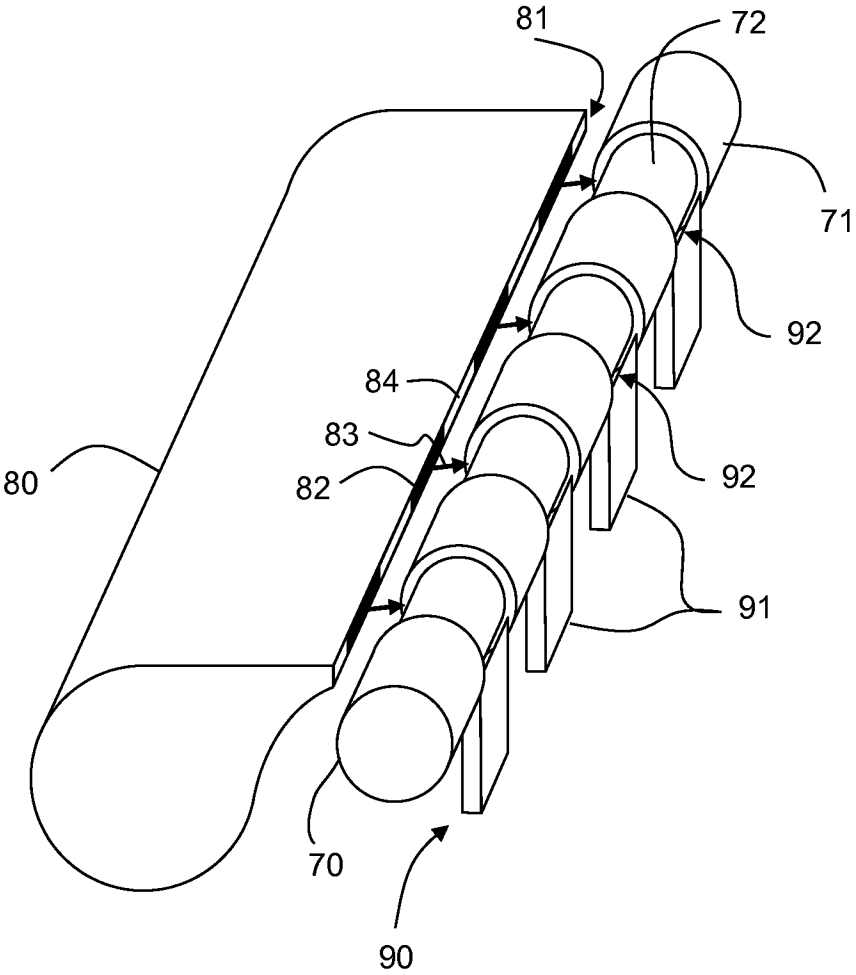
FIG. 16 shows a perspective of the air source, the web-guiding structure and the air restrictor fingers of FIG. 15.

FIGS. 15-16 illustrate an embodiment where air restrictor 90 includes fingers 91 with wedge-shaped finger tips 92 that are inserted into the recesses 72 between the first side 15 of the receiver media 10 and the web-guiding structure 70. In order not to add drag and wear onto either the web-guiding structure 70 or the receiver media 10, it is preferable that the finger tips 92 do not contact either the recesses 72 of the rotating web-guiding structure 70 or the web of receiver media 10. In some embodiments, in order to properly position all of the finger tips 92, a support member 93 can be used to join all of the fingers 91 at their bases opposite the finger tips 92 into a single piece as illustrated in FIG. 17.

Figure 18:
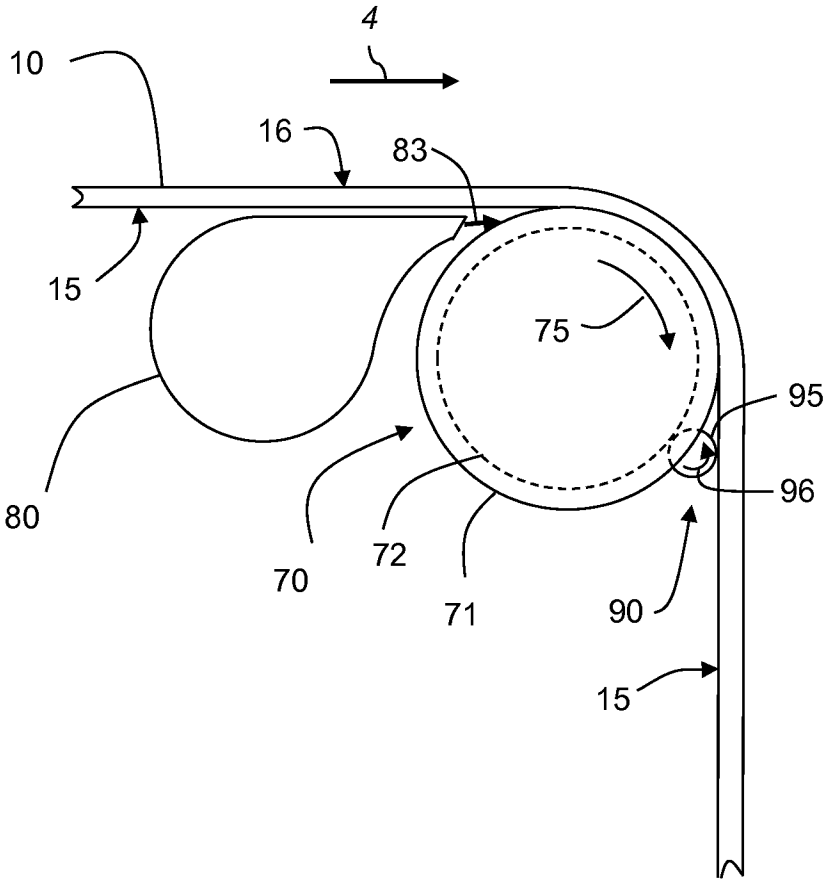
FIG. 18 shows an end view of a web-guiding system similar to FIG. 15 but where the air restrictors are rollers.
Figure 20:
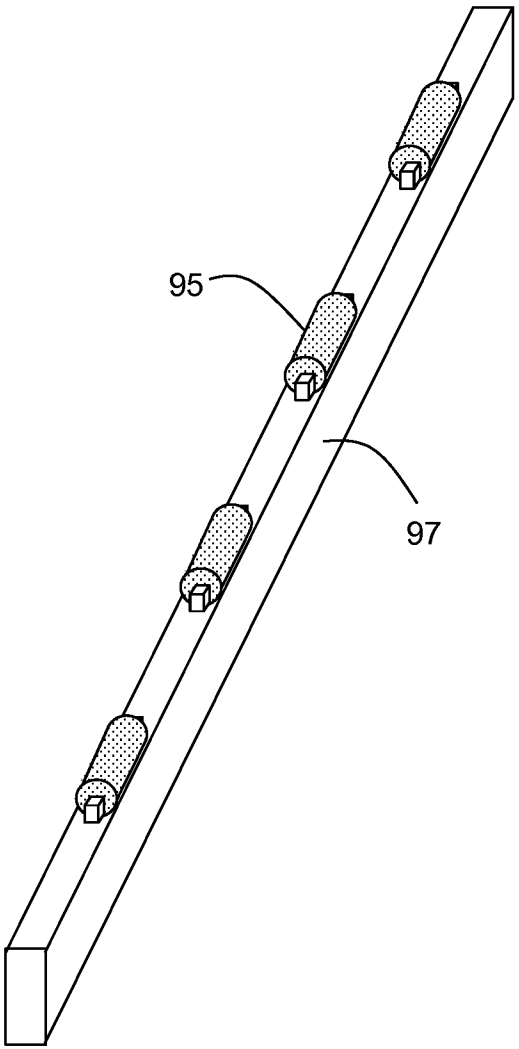
FIG. 20 shows a perspective of a common support member for the air restrictor rollers of FIG. 19.
Figure 19:
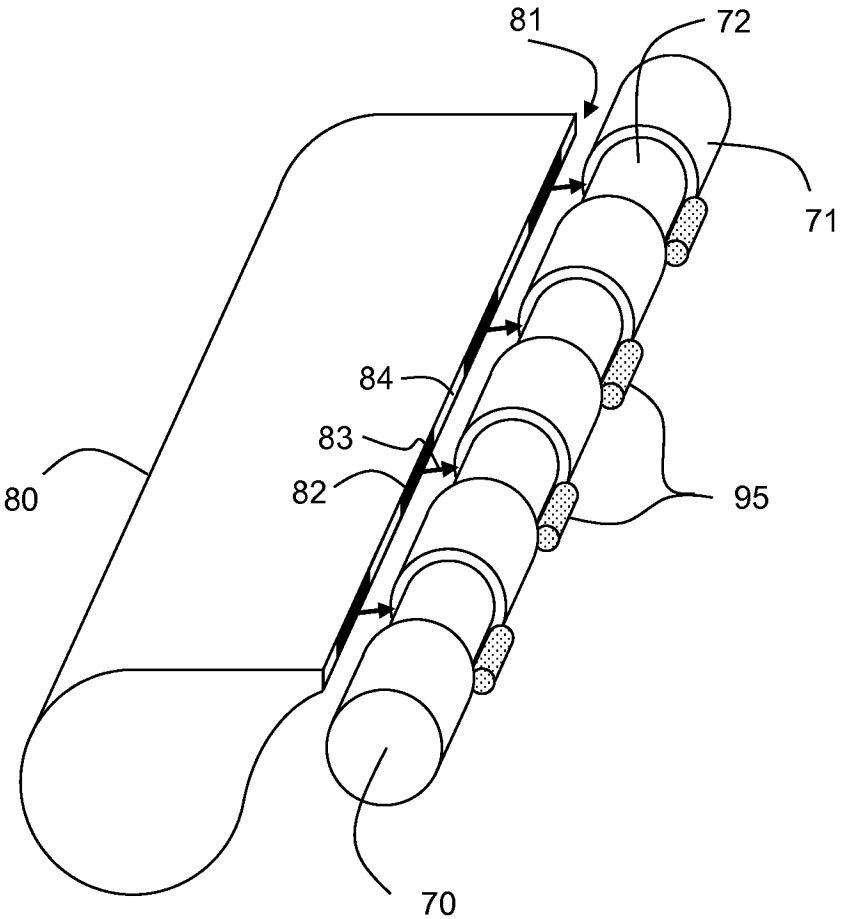
FIG. 19 shows a perspective of the air source, the web-guiding structure and the air restrictors of FIG. 18.

FIGS. 18-19 illustrate an embodiment where the air restrictor 90 includes air restricting rollers 95, which are inserted between the first side 15 of the receiver media 10 and the web-guiding structure 70. In some embodiments, the air restricting rollers 95 can be allowed to contact either the web-guiding structure 70 or the web of receiver media 10, but it is preferable that the air restricting rollers 95 do not contact both. If the air restricting rollers 95 contact a rotating web-guiding structure 70 they will be caused to rotate in rotation direction 96, such that a surface of the air restricting rollers 95 facing the receiver media 10 would be moving in the opposite direction from the web of receiver media 10. In order to position all of the air restricting rollers 95, they can be mounted on a common support member 97 as illustrated in FIG. 20.

Figure 21:
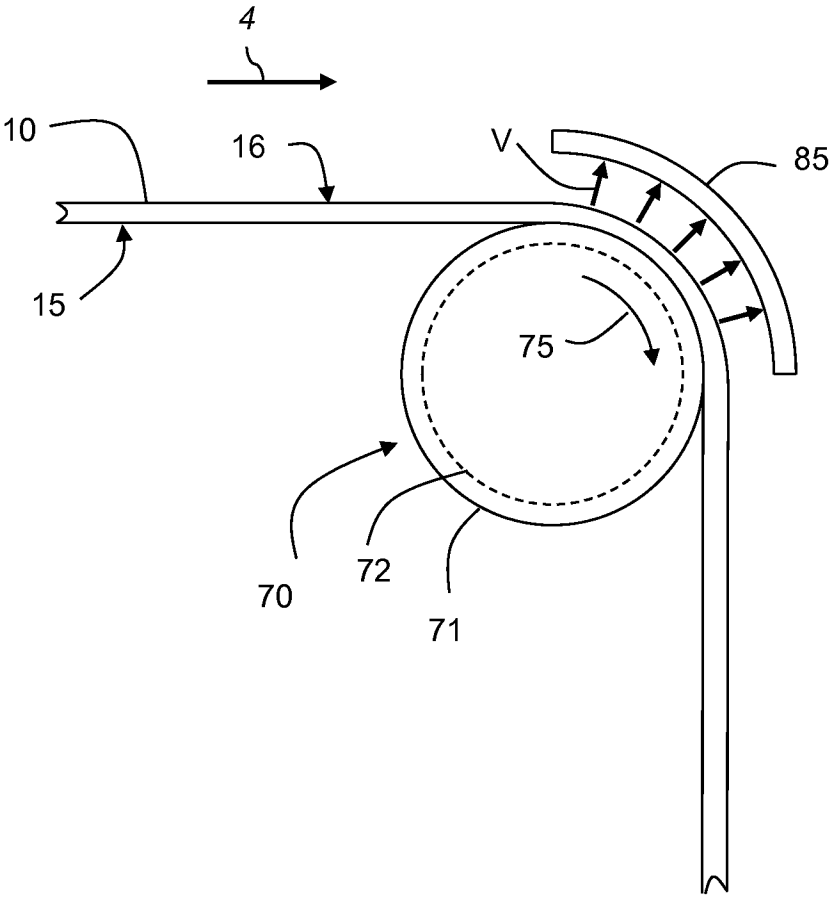
FIG. 21 shows an end view of a web-guiding system similar to FIG. 6 where a vacuum system is used to pull portions of the web of receiver media away from the web guiding structure.
Figure 22:
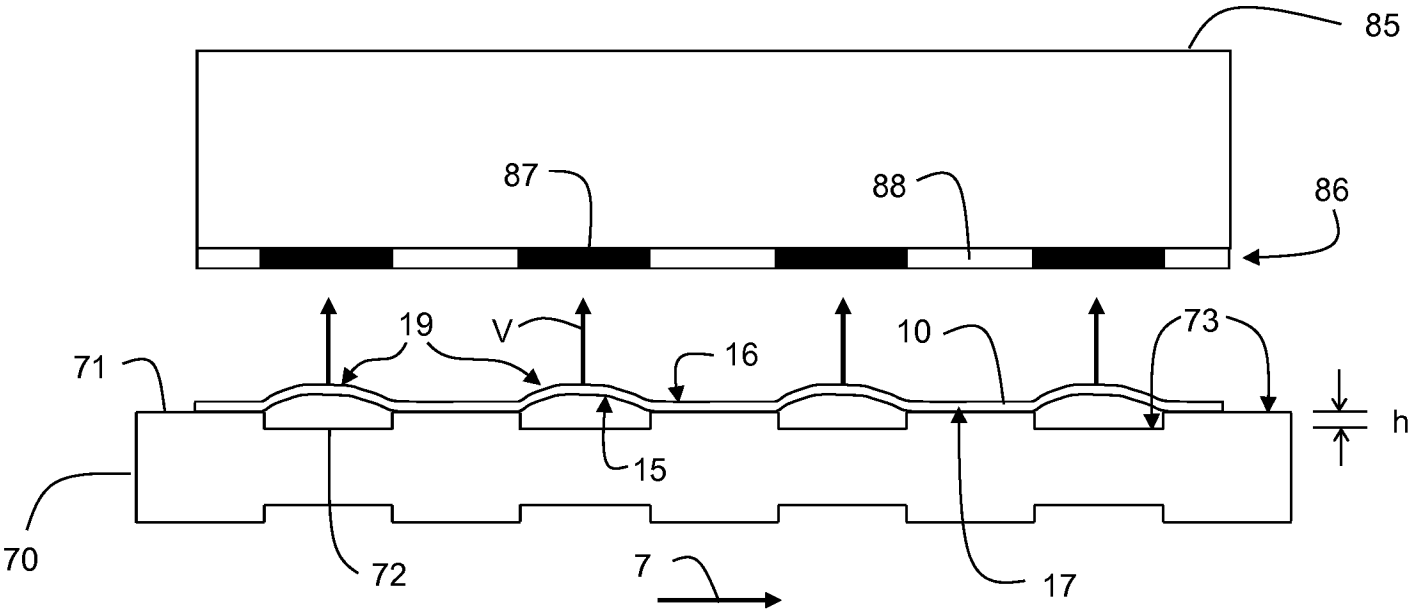
FIG. 22 shows a vacuum system including a manifold for providing a vacuum force that varies across the cross-track direction.

In the embodiments described above, an air source 80 has been used to provide a positive air flow 83 between the first side 15 of the web of receiver media 10 and the web-guiding structure 70 to provide a lifting force F (FIG. 7). FIGS. 21-22 illustrate an alternate embodiment where a vacuum system 85 is positioned such that the web of receiver media 10 passes between the web-guiding structure 70 and the vacuum system 85. In this configuration, the vacuum system 85 is adapted to provide a vacuum force V to pull the second side 16 of the web of receiver media 10 toward the vacuum system 85, thereby lifting receiver media portions 19 overlying the recesses 72 away from the exterior surface 73 of the web-guiding structure 70.

As shown in FIG. 22, a manifold 86 can be provided to vary the magnitude of the vacuum force V across the cross-track direction 7 of the receiver media 10. For example, the manifold 86 of the vacuum system 85 can have openings 87 alternating with blockages 88, where the openings 87 are aligned with the recesses 72 of the web-guiding structure 70 such that the vacuum force V is directed to the receiver media portions 19 overlying the recesses 72. In some embodiments at least some of the blockages 88 are sliding doors that can be repositioned to adjust the vacuum profile. For example, the blockages 88 toward the ends of the manifold 86 can be opened or closed to adjust the vacuum profile to have a cross-track width (along the cross-track direction 7) in accordance with a cross-track width of the web of receiver media 10. In other embodiments, the manifold can be configured so that the amount of vacuum force V can be greater or less at positions near the ends of web-guiding structure 70 than at positions near the center of the web-guiding structure in order to provide a varying amount of vacuum force V across the web of receiver media 10.

The invention has been described in detail with particular reference to certain preferred embodiments thereof, but it will be understood that variations and modifications can be effected within the spirit and scope of the invention.

PARTS LIST

2 roller
3 receiver media
4 in-track direction
5 flute
7 cross-track direction
8 contact surface
9 exit direction
10 receiver media
11 source roll
12 take-up roll
15 first side
16 second side
17 receiver media portions
18 receiver media portions
19 receiver media portions
20*a* printhead
20*b* printhead
20*c* printhead
20*d* printhead
21 print line
22 print line
25*a* printhead
25*b* printhead
30 web guiding system
31 print line roller
32 print line roller
40 dryer
41 dryer roller
45 quality control sensor
50 printing module
51 first zone
52 second zone
55 printing module
60 turnover mechanism
61 first end
62 second end
65 printing module
68 concave surface profile
69 convex surface profile
70 web-guiding structure
71 ridge
72 recess
73 exterior surface
74 rounded edges
75 rotation direction
76 entry contact boundary
77 exit contact boundary
78 air inlet
79 air holes
80 air source
81 manifold
82 opening
83 air flow
84 blockage
85 vacuum system
86 manifold
87 opening
88 blockage
90 air restrictor
91 finger
92 finger tip
93 support member
95 air restricting roller
96 rotation direction
97 support member
100 printing system
110 printing system
170 fixed web-guiding structure
d diameter
D diameter
$D_{end}$ diameter
$D_{mid}$ diameter
F lifting force
h depth
V vacuum force
α wrap angle
β skew angle

The invention claimed is:

1. A web-guiding system for guiding a web of media travelling from upstream to downstream along a transport path in an in-track direction, the web of media having a first side and an opposing second side, comprising:

a web-guiding structure including an exterior surface having a pattern of recesses formed into the exterior surface, wherein the web of media travels past the web-guiding structure with the first side of the web of media contacting at least some non-recessed portions of the exterior surface of the web-guiding structure;

an air source for providing an air flow between the first side of the web of media and the exterior surface of the web-guiding structure thereby producing a lifting force to lift portions of the web of media overlying the recesses away from the exterior surface of the web-guiding structure; and wherein the air source is located downstream of the web-guiding structure and blows air between the first side of the web of media and the exterior surface of the web-guiding structure along a boundary where the web of media leaves contact with the web-guiding structure.

2. The web-guiding system of claim 1 wherein a direction of travel of the web of media is redirected by at least 2 degrees as it travels along the transport path past the web-guiding structure.

3. The web-guiding system of claim 1 wherein the exterior surface of the web-guiding structure is curved.

4. The web-guiding system of claim 1 wherein the web-guiding structure is a rotating roller.

5. The web-guiding system of claim 4 wherein a diameter of the exterior surface of the roller varies along a length of the roller to provide a convex or a concave surface profile.

6. The web-guiding system of claim 1 wherein the exterior surface of the web-guiding structure is provided by a fixed media support having a surface facing the web of media.

7. The web-guiding system of claim 6 wherein the exterior surface of the fixed media support has an arc-shaped cross-section.

8. The web-guiding system of claim 6 wherein the exterior surface is fabricated using a material having a coefficient of friction with the web of receiver of less than 0.2.

9. The web-guiding system of claim 1 wherein the recesses formed into the exterior surface of the web-guiding structure have rounded edges where they meet the non-recessed portions of the exterior surface of the web-guiding structure.

10. The web-guiding system of claim 1 wherein the recesses include a plurality of grooves that extend along at least a portion of the exterior surface of the web-guiding structure, each of the grooves being parallel to the in-track direction.

11. The web-guiding system of claim 1 wherein the air flow provided between the first side of the web of media and the exterior surface of the web-guiding surface varies as a function of cross-track position along a length of the web-guiding structure.

12. The web-guiding system of claim 11, wherein the air source includes a manifold with openings that are aligned with the recesses to vary the air flow across a cross-track length of the web-guiding structure such that the lifting force is directed to the portions of the web of media overlying the recesses.

13. The web-guiding system of claim 11 wherein the air source includes an adjustable manifold providing an adjustable cross-track air flow profile.

14. The web-guiding system of claim 1 further including an air restrictor positioned on an opposite side of the web-guiding structure from the air source adapted to restrict the air flow which passes between the first side of the web of media and the exterior surface of the web-guiding structure.

15. The web-guiding system of claim 1 wherein the web-guiding system is a component of a printing system adapted to print on one or both sides of the web of media.

16. A web-guiding system for guiding a web of media travelling from upstream to downstream along a transport path in an in-track direction, the web of media having a first side and an opposing second side, comprising:

a web-guiding structure including an exterior surface having a pattern of recesses formed into the exterior surface, wherein the web of media travels past the web-guiding structure with the first side of the web of media contacting at least some non-recessed portions of the exterior surface of the web-guiding structure; and an air source for providing an air flow between the first side of the web of media and the exterior surface of the web-guiding structure thereby producing a lifting force to lift portions of the web of media overlying the recesses away from the exterior surface of the web-guiding structure;

wherein the air source is located upstream of the web-guiding structure and blows air between the first side of the web of media and the exterior surface of the web-guiding structure along a boundary where the web of media first comes into contact with the web-guiding structure; and further including a second air source, the second the air source being located downstream of the web-guiding structure and blows air between the first side of the web of media and the exterior surface of the web-guiding structure along a boundary where the web of media leaves contact with the web-guiding structure.

17. The web-guiding system of claim 16 wherein the web-guiding structure is a rotating roller.

18. The web-guiding system of claim 16 wherein the recesses include a plurality of grooves that extend along at least a portion of the exterior surface of the web-guiding structure, each of the grooves being parallel to the in-track direction.

19. The web-guiding system of claim 16 wherein the air flow provided between the first side of the web of media and the exterior surface of the web-guiding surface varies as a function of cross-track position along a length of the web-guiding structure.

20. A web-guiding system for guiding a web of media travelling from upstream to downstream along a transport path in an in-track direction, the web of media having a first side and an opposing second side, comprising:

a web-guiding structure including an exterior surface having a pattern of recesses formed into the exterior surface, wherein the web of media travels past the web-guiding structure with the first side of the web of media contacting at least some non-recessed portions of the exterior surface of the web-guiding structure;

an air source for providing an air flow between the first side of the web of media and the exterior surface of the web-guiding structure thereby producing a lifting force to lift portions of the web of media overlying the recesses away from the exterior surface of the web-guiding structure; and an air restrictor positioned on an opposite side of the web-guiding structure from the air source adapted to restrict the air flow which passes between the first side of the web of media and the exterior surface of the web-guiding structure, wherein the air restrictor includes fingers or rollers that are positioned in the recesses between the first side of the receiver media and the exterior surface of the web-guiding structure.

21. The web-guiding system of claim 20 wherein the air source is located upstream of the web-guiding structure and blows air between the first side of the web of media and the exterior surface of the web-guiding structure along a boundary where the web of media first comes into contact with the web-guiding structure.

22. The web-guiding system of claim 20 wherein the web-guiding structure is a rotating roller.

23. The web-guiding system of claim 20 wherein the air flow provided between the first side of the web of media and the exterior surface of the web-guiding surface varies as a function of cross-track position along a length of the web-guiding structure.

* * * * *